US012209384B2

(12) United States Patent
Kean et al.

(10) Patent No.: US 12,209,384 B2
(45) Date of Patent: Jan. 28, 2025

(54) LASER REFERENCE TRACKING AND TARGET CORRECTIONS FOR WORK MACHINES

(71) Applicant: Deere & Company, Moline, IL (US)

(72) Inventors: Michael G. Kean, Maquoketa, IA (US); Bryan J. Rausch, Durango, IA (US)

(73) Assignee: Deere &Company, Moline, IL (US)

( * ) Notice: Subject to any disclaimer, the term of this patent is extended or adjusted under 35 U.S.C. 154(b) by 743 days.

(21) Appl. No.: 17/479,470

(22) Filed: Sep. 20, 2021

(65) Prior Publication Data

US 2023/0092265 A1 Mar. 23, 2023

(51) Int. Cl.

| | |
|---|---|
| ***E02F 9/26*** | (2006.01) |
| ***E02F 3/43*** | (2006.01) |
| ***E02F 3/84*** | (2006.01) |

(52) U.S. Cl.

CPC ..... *E02F 3/435* (2013.01); *E02F 3/847* (2013.01); *E02F 9/262* (2013.01); *E02F 9/265* (2013.01)

(58) Field of Classification Search

CPC ..... E02F 3/847; E02F 9/262; E02F 9/265
See application file for complete search history.

(56) References Cited

U.S. PATENT DOCUMENTS

| | | | | |
|---|---|---|---|---|
| 4,111,066 | A | 9/1978 | Kendrick | |
| 4,945,221 | A | 7/1990 | Nielsen et al. | |
| 6,477,914 | B1 | 11/2002 | Krieger | |
| 6,532,409 | B1 * | 3/2003 | Fujishima | E02F 9/2045 37/234 |
| 6,736,216 | B2 | 5/2004 | Savard et al. | |
| 7,477,973 | B2 | 1/2009 | Brewer et al. | |
| 8,141,650 | B2 | 3/2012 | Breiner et al. | |
| 8,180,532 | B2 | 5/2012 | O'Halloran et al. | |
| 8,634,991 | B2 | 1/2014 | Douglas | |
| 8,689,471 | B2 | 4/2014 | Carpenter et al. | |
| 8,919,455 | B2 | 12/2014 | Hendron et al. | |
| 9,328,479 | B1 | 5/2016 | Rausch et al. | |
| 9,428,885 | B2 | 8/2016 | Nau | |
| 9,551,115 | B2 | 1/2017 | Engels et al. | |
| 9,551,130 | B2 | 1/2017 | Hendron et al. | |
| 9,624,643 | B2 | 4/2017 | Hendron et al. | |
| 9,638,525 | B1 | 5/2017 | Willis | |
| 9,995,016 | B1 | 6/2018 | Howell et al. | |

(Continued)

FOREIGN PATENT DOCUMENTS

WO 2008129345 A1 10/2008

*Primary Examiner* — Anshul Sood
(74) *Attorney, Agent, or Firm* — Gary L. Montle; Lucian Wayne Beavers; Patterson Intellectual Property Law, PC

(57) ABSTRACT

A system and method are provided for operating a work machine comprising a laser receiver and an implement for working a terrain. Responsive to movement of the laser receiver, a laser reference is received at a plurality of positions relative to a transmitting laser source, wherein the laser reference corresponds in slope and direction at a defined elevation offset with respect to a target surface profile of the terrain being worked. A plane of the laser reference is determined from data points corresponding to the plurality of positions at which the laser reference is received, and movement of at least the implement is controlled with respect to at least the determined plane of the laser reference and the defined elevation offset.

20 Claims, 4 Drawing Sheets

(56) References Cited

U.S. PATENT DOCUMENTS

| | | | | |
|---|---|---|---|---|
| 10,094,654 | B2 | 10/2018 | Crozier et al. | |
| 10,401,176 | B2 | 9/2019 | Nackers et al. | |
| 10,532,741 | B2 | 1/2020 | Kean et al. | |
| 10,704,233 | B2 | 7/2020 | Dusha | |
| 2006/0123673 | A1* | 6/2006 | Glover | E02F 3/842 37/348 |
| 2009/0228169 | A1* | 9/2009 | Chiorean | G01B 21/042 455/41.2 |
| 2010/0229409 | A1* | 9/2010 | Kumagai | G05D 1/0236 33/285 |
| 2011/0311342 | A1 | 12/2011 | Montgomery | |
| 2013/0080112 | A1 | 3/2013 | Friend | |
| 2014/0168009 | A1 | 6/2014 | Peake | |
| 2014/0343800 | A1 | 11/2014 | Nelson et al. | |
| 2015/0292179 | A1* | 10/2015 | Joergensen | E02F 9/265 701/50 |
| 2019/0100205 | A1 | 4/2019 | Kean et al. | |
| 2019/0234045 | A1 | 8/2019 | Wiewel et al. | |
| 2021/0189667 | A1 | 6/2021 | Fritz | |
| 2023/0203791 | A1* | 6/2023 | Saito | E02F 3/435 701/50 |

* cited by examiner

LASER REFERENCE TRACKING AND TARGET CORRECTIONS FOR WORK MACHINES

FIELD OF THE DISCLOSURE

The present disclosure relates generally to work machines such as hydraulic graders, and for example to grade control systems and methods for such work machines without global navigation satellite system (GNSS) antennas that operate using a laser plane.

BACKGROUND

Work machines within the scope of the present disclosure may for example include not only hydraulic excavators but loaders, crawlers, motor graders, backhoes, forestry machines, front shovel machines, and others. These work machines may typically have wheeled or tracked ground engaging units supporting a frame and/or undercarriage from the ground surface, but work machines within the scope of the present disclosure may also include stationary frames with one or more components moveable relative thereto. Work machines as disclosed herein may include for example a work implement, which includes one or more components, that is used to modify the terrain based on control signals from and/or in coordination with movement of the work machine.

In the particular context of grade control applications, such systems may be generally split into two broad categories. Two-dimensional grade control is where the work machine is expected to cut a surface in one direction. The two dimensions controlled by the grade control system are the depth of cut and the slope of cut. Three-dimensional grade control is used when the grade control system needs to cut a compound slope or in situations where lateral positioning of the work machine is important. Three-dimensional applications typically require either a GNSS antenna or a robotic surveying station in addition to all of the other sensors required for a two-dimensional grade control application. One of the conventional challenges in two-dimensional grading applications is how to maintain a common height reference as the ground engaging units of the work machine are moved. The three-dimensional grade control system uses its external reference system to accomplish this, whereas two-dimensional systems often require a common touch point before and after moving the ground engaging units or the use of a laser plane.

When using a laser plane, the grade control system may determine the depth of the desired surface from the laser plane. A sensor such as a conventional laser receiver, for example on the arm of an excavator as the work machine at issue, senses the laser and corrects for any change in vertical reference due to track motion. When the laser plane is sloped, the work machine is able to cut a sloped surface. However, this requires the work machine to be oriented either in parallel or perpendicular with respect to the slope of the laser plane. If the work machine is misaligned, the slope it cuts will not be parallel to the laser plane, since the grade control system does not know how to orient its internal slope command relative to the height of the laser plane and can only adjust the depth of cut.

BRIEF SUMMARY

The current disclosure provides an enhancement to conventional systems, at least in part by introducing a novel grade control system and method for tracking a laser reference and calculating control headings with respect to the work machine coordinate system in a manner that is agnostic with respect to the type (or presence) of an inertial navigation system, and further does not require GNSS implementation.

In one example, a user rotates a laser receiver of a work machine through a laser plane having a target slope and direction, and further having a defined height offset with respect to a target surface profile. The system can accordingly calculate the slope, direction, and height automatically. Exemplary benefits of such as solution may include that the operator only needs to know the height offset with respect to the measured height, slope, and direction, wherein the machine itself is configured to match the laser settings.

For example, as the work machine rotates with the laser receiver in the reference laser plane, a cloud of three-dimensional points may be collected along the arc of rotation. These points may be measured with respect to the independent coordinate frame of the work machine. By best-fitting a plane to these three-dimensional points, the slope, direction, and height of the laser plane can further be obtained or otherwise calculated in the machine coordinate system. These can then be combined with a predetermined or otherwise obtained vertical offset and used as a design target for a grade control operation.

In one particular and exemplary embodiment, a method is disclosed herein for operating a work machine comprising a laser receiver and at least one implement for working a terrain. The method includes, responsive to movement of the laser receiver, receiving via the laser receiver a laser reference transmitted from a laser source at a plurality of positions relative to the laser source, wherein the laser reference corresponds in slope and direction at a defined elevation offset with respect to a target surface profile of the terrain being worked. A plane of the laser reference is determined from data points corresponding to the plurality of positions at which the laser reference is received by the laser receiver, and movement of at least the at least one implement is controlled for working the terrain based at least in part on the determined plane of the laser reference and the defined elevation offset.

In one exemplary aspect according to the above-referenced embodiment, the target surface profile is determined in a work machine coordinate system based on the determined plane of the laser reference and the defined elevation offset, and movement of at least the at least one implement is controlled for working the terrain with respect to the determined target surface profile.

In another exemplary aspect according to the above-referenced embodiment, a position of the work machine in a target surface coordinate system is determined based on the determined plane of the laser reference and the defined elevation offset, wherein movement of at least the at least one implement for working the terrain is controlled with respect to the determined target surface profile.

In another exemplary aspect according to the above-referenced embodiment, the work machine comprises a frame supported by a plurality of ground engaging units and the at least one implement is configured to selectively rotate about an axis associated with the frame. Movement of the plurality of ground engaging units may be detected, wherein the method further includes predicting at least one position at which the laser reference will be received by the laser receiver, and determining a tracking error based on whether the laser reference is received at the predicted at least one position.

In another exemplary aspect according to the above-referenced embodiment, prompts are generated to an operator via an onboard user interface to initiate a tracking correction routine comprising movements of the laser receiver, responsive to the determining of a tracking error, wherein the laser reference is monitored for receipt at a plurality of positions for determining a corrected plane of the laser reference.

In another exemplary aspect according to the above-referenced embodiment, at least two of the plurality of positions in the tracking correction routine are predetermined.

In another exemplary aspect according to the above-referenced embodiment, at least two of the plurality of positions in the tracking correction routine correspond to swing angles of the implement with respect to the frame of at least a predetermined distance apart.

In another exemplary aspect according to the above-referenced embodiment, a tracking correction routine is automatically initiated, responsive to the determining of a tracking error, wherein the laser reference is monitored for receipt at a plurality of positions for determining a corrected plane of the laser reference.

In another exemplary aspect according to the above-referenced embodiment, the work machine comprises a frame supported by a plurality of ground engaging units and the at least one implement is configured to selectively rotate about an axis associated with the frame. Upon for example detecting movement of the plurality of ground engaging units, prompts are generated to an operator via an onboard user interface to initiate a tracking correction routine, responsive to the detected movement, wherein the laser receiver is moved to receive the laser reference at a plurality of positions for determining a corrected plane of the laser reference.

In another exemplary aspect according to the above-referenced embodiment, a plurality of user-selectable operating modes may be enabled. In one mode, the system may automatically attempt to determine the plane of the laser reference responsive to any movement of the laser receiver, and generate output signals to an onboard user interface based on a state of the determined plane of the laser reference and/or the determined target surface profile. For example, an alert may be generated if there is ambiguity regarding the orientation of the laser plane with respect to the work machine coordinates, and/or if a substantial misalignment has been detected. In another mode, the laser reference may be automatically monitored for receipt at a plurality of positions for determining a plane of the laser reference without generating an output signal to alert an operator.

In another exemplary aspect according to the above-referenced embodiment, for example where a visual-inertial navigation system (VINS) is provided, the method further may include sensing and classifying one or more static elements in an area surrounding the work machine, referencing the one or more static elements to the plane of the laser reference, and tracking at least the one or more static elements to determine movements of the work machine and to further track the plane of the laser reference relative to the work machine coordinate system.

Upon determining movement of the work machine based on at least the tracked one or more static elements, the exemplary method may further include predicting based on the tracked one or more static elements at least one position at which the laser reference will be received by the laser receiver, and determining a tracking error based on whether the laser reference is received at the predicted at least one position.

Upon detecting the laser reference in a position different from a predicted corresponding position, the exemplary method may further include selectively applying the determined tracking error to correct the navigation system.

In another exemplary embodiment, a work machine as disclosed herein may include a laser receiver, at least one implement for working a terrain, and a controller functionally linked to the laser receiver and the at least one implement. The controller may be configured to direct the performance of a method according to the above-referenced embodiment and optionally any of the associated exemplary aspects.

In another exemplary embodiment, a computer program product may be implemented for example via a processor configured to execute program instructions residing on a non-transitory computer-readable medium, wherein such execution may produce steps of a method according to the above-referenced embodiment and optionally any of the associated exemplary aspects. The computer program product may be associated with a work machine controller, or may comprise a processor communicatively linked with the work machine controller for distributed and/or collective execution of the steps, and in certain embodiments may be implemented via a remote server network, mobile computing device, or the like.

Numerous objects, features, and advantages of the embodiments set forth herein will be readily apparent to those skilled in the art upon reading of the following disclosure when taken in conjunction with the accompanying drawings.

DETAILED DESCRIPTION

Figure 1:
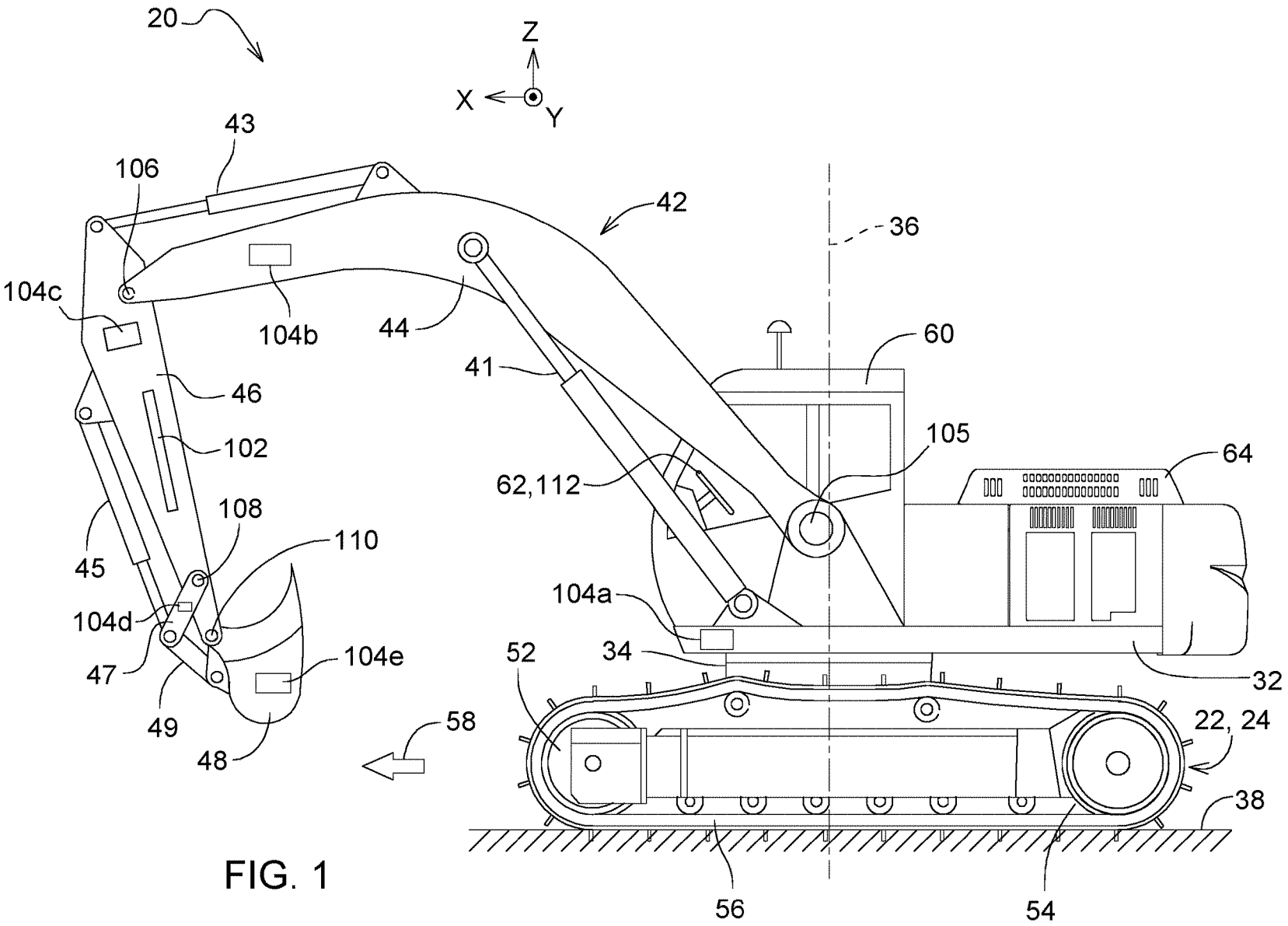
FIG. 1 is a side view representing an excavator as an exemplary work machine according to an embodiment of the present disclosure.

FIG. 1 depicts a representative self-propelled work machine 20 in the form of, for example, a tracked excavator machine. The work machine 20 includes an undercarriage 22 including first and second ground engaging units 24 including first and second travel motors (not shown) for driving the first and second ground engaging units 24, respectively. A main frame 32 is supported from the undercarriage 22 by a swing bearing 34 such that the main frame 32 is pivotable about a pivot axis 36 relative to the undercarriage 22. The pivot axis 36 is substantially vertical when a ground surface 38 engaged by the ground engaging units 24 is substantially horizontal. A swing motor (not shown) is configured to pivot the main frame 32 on the swing bearing 34 about the pivot axis 36 relative to the undercarriage 22.

In an embodiment, a swing angle sensor (not shown) may include an upper sensor part mounted on the main frame 32 and a lower sensor part mounted on the undercarriage 22.

Such a swing angle sensor may be configured to provide a swing (or pivot) angle signal corresponding to a pivot position of the main frame 32 relative to the undercarriage 22 about the pivot axis 36. The swing angle sensor may for example be a Hall Effect rotational sensor including a Hall element, a rotating shaft, and a magnet, wherein as the angular position of the Hall element changes, the corresponding changes in the magnetic field result in a linear change in output voltage. Other suitable types of rotary position sensors include rotary potentiometers, resolvers, optical encoders, inductive sensors, and the like.

A work implement 42 in the context of the referenced work machine 20 is a boom assembly having numerous components in the form of a boom 44 pivotably connected to the main frame 32 at a linkage joint 105, an arm 46 pivotally connected to the boom 44 at a linkage joint 106, and a working tool 48. The boom 44 is pivotally attached to the main frame 32 to pivot about a generally horizontal axis relative to the main frame 32. The working tool 48 in this embodiment is an excavator shovel, which is pivotally connected to the arm 46 at a linkage joint 110. One end of a dogbone 47 is pivotally connected to the arm 46 at a linkage joint, and another end of the dogbone 47 is pivotally connected to a tool link 49. A tool link 49 in the context of the referenced work machine 20 is a bucket link 49.

The boom assembly 42 extends from the main frame 32 along a working direction of the boom assembly 42. The working direction can also be described as a working direction of the boom 44. As described herein, control of the work implement 42 may relate to control of any one or more of the associated components (e.g., boom 44, arm 46, tool 48).

Referring again to the embodiment of FIG. 1, the first and second ground engaging units 24 are tracked ground engaging units but in various embodiments may be wheels. Each of the tracked ground engaging units 24 includes a front idler 52, a drive sprocket 54, and a track chain 56 extending around the front idler 52 and the drive sprocket 54. The travel motor of each tracked ground engaging unit 24 drives its respective drive sprocket 54. Each tracked ground engaging unit 24 has a forward traveling direction 58 defined from the drive sprocket 54 toward the front idler 52. The forward traveling direction 58 of the tracked ground engaging units 24 also defines a forward traveling direction 58 of the undercarriage 22 and thus of the working machine 20.

An operator's cab 60 may be located on the main frame 32. The operator's cab 60 and the boom assembly 42 may both be mounted on the main frame 32 so that the operator's cab 60 faces in the working direction 58 of the boom assembly. A control station 62 may be located in the operator's cab 60.

Also mounted on the main frame 32 is an engine 64 for powering the working machine 20. The engine 64 may be a diesel internal combustion engine. The engine 64 may drive a hydraulic pump to provide hydraulic power to the various operating systems of the working machine 20.

Figure 3:
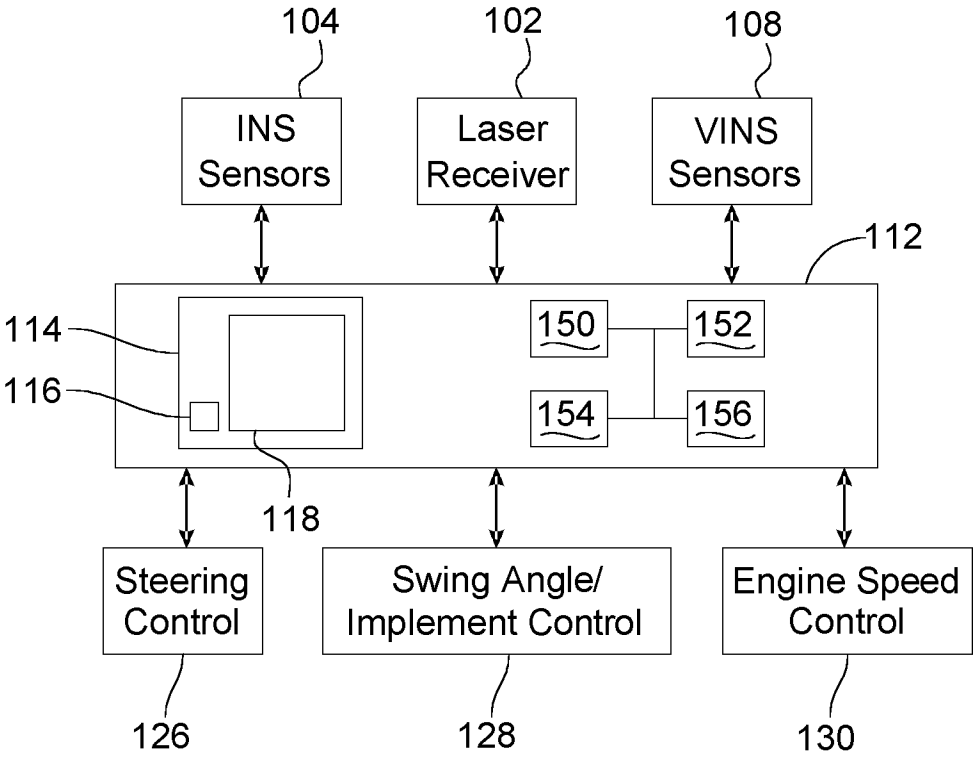
FIG. 3 is a block diagram representing an exemplary control system according to an embodiment of the present disclosure.

As schematically illustrated in FIG. 3, the work machine 20 may include a control system including a controller 112. The controller may be part of the machine control system of the working machine, or it may be a separate control module. The controller 112 may include a user interface 114 and optionally be mounted in the operator's cab 60 at the control station 62.

The controller 112 is configured to receive input signals from some or all of various sensors 102, 104, 108 as further described below. Various sensors 102, 104, 108 may typically be discrete in nature, but signals representative of more than one input parameter may be provided from the same sensor, and a sensor system 102, 104, 108 as disclosed herein may further include or otherwise refer to signals provided from the machine control system.

In an embodiment a set of inertial navigation system (INS) sensors 104 may be mounted on the work machine 20, as represented generally including multiple sensors 104*a*, 104*b*, 104*c*, 104*d*, 104*e* respectively mounted to the main frame 32, the boom 44, the arm 46, the dogbone 47, and the tool 48.

In the embodiment represented in FIG. 1, which is intended as illustrative and non-limiting unless otherwise specifically noted herein, a sensor system 104 may include a sensor 104*a* mounted on the main frame 32; a sensor 104*b* mounted on the boom 44; a sensor 104*c* mounted on the arm 46; a sensor 104*d* mounted on the dogbone 47; and a sensor 104*e* mounted on the tool 48. Respective sensors may for example be mounted on opposing sides of at least one linkage joint. An opposing side of the at least one linkage joint may be ascertained by mounting or affixation of the sensor system 104 on either side of the at least one linkage joint, which is defined as a pivotal linkage joint connecting the one or more components of the work implement 42.

For example, the at least one linkage joint may be defined at a linkage joint 106, which constitutes a pivotal connection of the boom 44 and the arm 46. In this example, the sensor system 104 may be mounted in such a manner that the opposing sides of the at least one linkage joint are defined as follows: the sensor 104*b* mounted on the boom 44 opposing the sensor 104*c* mounted on the arm 46; the sensor 104*b* mounted on the boom 44 opposing the sensor 104*d* mounted on the dogbone 47; or the sensor 104*b* mounted on the boom 44 opposing the sensor 104*e* mounted on the tool 48.

As a further example, the at least one linkage joint may be defined at a pivotal connection of the arm 46 to the dogbone 47. In this example, the sensor system 104 may be mounted in such a manner that the opposing sides of the at least one linkage joint are defined as follows: the sensor 104*c* mounted on the arm 46 opposing the sensor 104*d* mounted on the dogbone 47; the sensor 104*c* mounted on the arm 46 opposing the sensor 104*e* mounted on the tool 48; the sensor 104*b* mounted on the boom 44 opposing the sensor 104*d* mounted on the dogbone 47; or the sensor 104*b* mounted on the boom 44 opposing the sensor 104*e* mounted on the tool 48.

As a further example, the at least one linkage joint may be defined at a linkage joint 110, which constitutes a pivotal connection between the arm 46 and the tool 48. In this example, the sensor system 104 may be mounted in such a manner that the opposing sides of the at least one linkage joint are defined as follows: the sensor 104*d* mounted on the dogbone 47 opposing the sensor 104*e* mounted on the tool 48; the sensor 104*c* mounted on the arm 46 opposing the sensor 104*e* mounted on the tool 48; or the sensor 104*b* mounted on the boom 44 opposing the sensor 104*e* mounted on the tool 48.

The sensor system 104 may be oriented in an x-, y-, and z-axis coordinate system. Using as one example the sensor 104*c* as mounted on the arm 46 and the sensor 104*d* as mounted on the dogbone 47, respective body frames of the sensors 104*c* and 104*d* (not shown) may be mounted such that the x-axes of the aforementioned body frames point along the direction of the work implement 42. Alternatively, the body frame of the sensor 104*c* and the body frame of the sensor 104*d* may be mounted in a manner such that the z-axes of the aforementioned body frames point in the direction of the main frame 32 of the work machine 20 (i.e., the excavator). Because an x-, y-, and z-axis coordinate system may be defined arbitrarily, the foregoing are not intended as limiting. The x-, y-, and z-axis coordinate system, though it may be defined arbitrarily, relates to the mechanical axes of rotation for roll (i.e., rotation about the x-axis), pitch (i.e., rotation about the y-axis), and yaw (i.e., rotation about the z-axis).

Some or all of the sensors 104 in the context of the referenced work machine 20 may include inertial measurement units (each, an IMU). IMUS are tools that capture a variety of motion- and position-based measurements, including, but not limited to, velocity, acceleration, angular velocity, and angular acceleration.

IMUs may include a number of sensors including, but not limited to, accelerometers, which measure (among other things) velocity and acceleration, gyroscopes, which measure (among other things) angular velocity and angular acceleration, and magnetometers, which measure (among other things) strength and direction of a magnetic field. Generally, an accelerometer provides measurements, with respect to (among other things) force due to gravity, while a gyroscope provides measurements, with respect to (among other things) rigid body motion. The magnetometer provides measurements of the strength and the direction of the magnetic field, with respect to (among other things) known internal constants, or with respect to a known, accurately measured magnetic field. The magnetometer provides measurements of a magnetic field to yield information on positional, or angular, orientation of the IMU; similarly to that of the magnetometer, the gyroscope yields information on a positional, or angular, orientation of the IMU. Accordingly, the magnetometer may be used in lieu of the gyroscope, or in combination with the gyroscope, and complementary to the accelerometer, in order to produce local information and coordinates on the position, motion, and orientation of the IMU.

As conventionally known in the art, an accelerometer is an electro-mechanical device or tool used to measure acceleration ($m/s^2$), which is defined as the rate of change of velocity (m/s) of an object. Accelerometers sense either static forces (e.g., gravity) or dynamic forces of acceleration (e.g., vibration and movement). An accelerometer may receive sense elements measuring the force due to gravity. By measuring the quantity of static acceleration due to gravity of the Earth, an accelerometer may provide data as to the angle the object is tilted with respect to the Earth, the angle of which may be established in an x-, y-, and z-axis coordinate frame. However, where the object is accelerating in a particular direction, such that the acceleration is dynamic (as opposed to static), the accelerometer produces data which does not effectively distinguish the dynamic forces of motion from the force due to gravity by the Earth. Also as conventionally known in the art, a gyroscope is a device used to measure changes in orientation, based upon the object's angular velocity (rad/s) or angular acceleration ($rad/s^2$). A gyroscope may constitute a mechanical gyroscope, a micro-electro-mechanical system (MEMS) gyroscope, a ring laser gyroscope, a fiber-optic gyroscope, and/or other gyroscopes as are known in the art. Principally, a gyroscope is employed to measure changes in angular position of an object in motion, the angular position of which may be established in an x-, y-, and z-axis coordinate frame.

In an embodiment, for each of at least one linkage joint as referenced above, sense elements from the received sensor output signals may be fused in an independent coordinate frame associated at least in part with the respective linkage joint, the independent coordinate frame of which is independent of a global navigation frame for the work machine 20, wherein for example measurements received by sensor system 104 may be merged to produce a desired output in the work implement 42 of the work machine 20.

Figure 2:
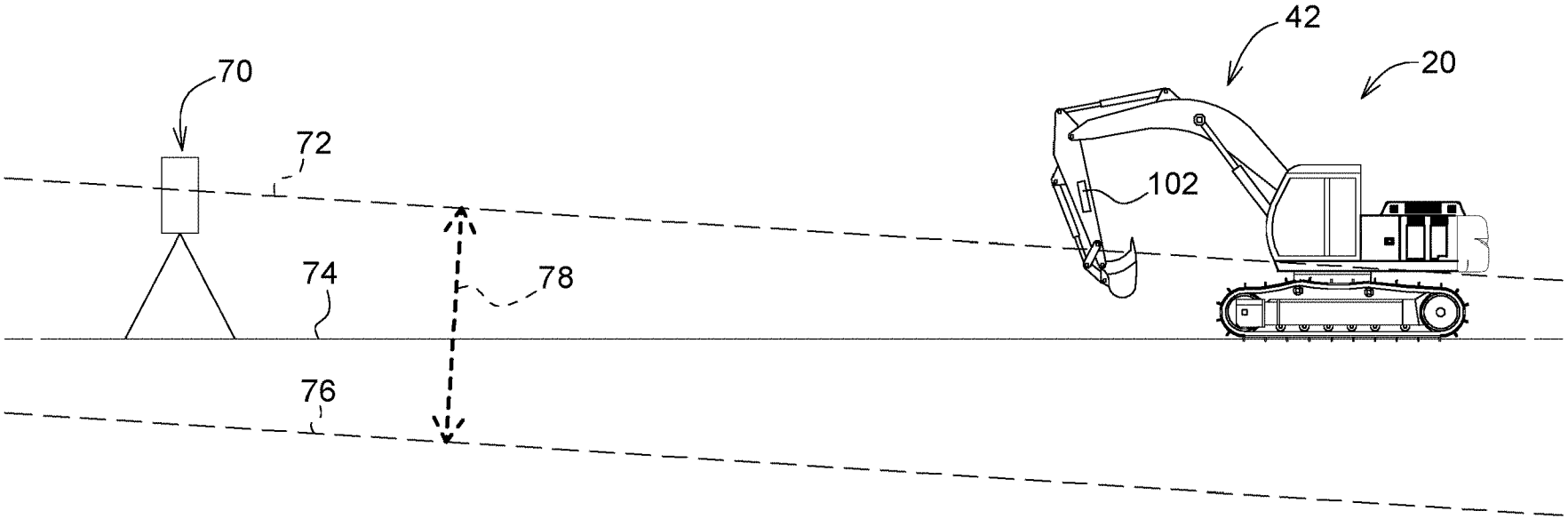
FIG. 2 is a side view representing the work machine of FIG. 1 in relation to a laser reference source according to an embodiment of the present disclosure.

One or more laser receivers 102 as are conventionally known in the art may further be mounted on the work machine 20 for catching a laser reference 72 as represented in FIG. 2. The laser reference 72 may be generated from a laser source 70 remotely positioned and in a stationary manner with respect to the work machine 20. A plane of the laser reference 72 may include a slope, direction, and height or predetermined/defined elevation offset 78 with respect to a target surface profile 76, the target surface profile 76 further corresponding to an amount of material to be graded away from an initial or current surface profile 74.

The controller 112 may be configured to produce outputs, as further described below, to a user interface 114 for display to the human operator or other appropriate user. The controller 112 may be configured to receive inputs from the user interface 114, such as user input provided via the user interface 114. Not specifically represented in FIG. 3, the controller 112 of the work machine 20 may in some embodiments further receive inputs from and generate outputs to remote devices associated with a user via a respective user interface, for example a display unit with touchscreen interface. Data transmission between for example a vehicle control system and a remote user interface may take the form of a wireless communications system and associated components as are conventionally known in the art. In certain embodiments, a remote user interface and vehicle control systems for respective work machines 20 may be further coordinated or otherwise interact with a remote server or other computing device for the performance of operations in a system as disclosed herein.

The controller 112 may further, or in the alternative, be configured to generate control signals for controlling the operation of respective actuators, or signals for indirect control via intermediate control units, associated with a machine steering control system 126, a machine implement control system 128, and/or an engine speed control system 130. The control systems 126, 128, 130 may be independent or otherwise integrated together or as part of a machine control unit in various manners as known in the art. The controller 112 may, for example, generate control signals for controlling the operation of various actuators, such as hydraulic motors or hydraulic piston-cylinder units 41, 43, 45, and electronic control signals from the controller 112 may actually be received by electro-hydraulic control valves associated with the actuators such that the electro-hydraulic control valves will control the flow of hydraulic fluid to and from the respective hydraulic actuators to control the actuation thereof in response to the control signal from the controller 112. In an embodiment, the controller 112 may in the context of a control operation further receive a pivot angle signal from a pivot angle sensor as described above and selectively drive a swing motor automatically to rotate the main frame 32 about the pivot axis 36 relative to the undercarriage 22 to a target pivot position of the main frame 32 relative to the undercarriage 22, as part of an aforementioned control unit 126, 128, 130 or optionally as a separate and/or integrated control unit within the scope of the present disclosure.

The controller 112 may include, or be associated with, a processor 150, a computer readable medium 152, a communication unit 154, data storage 156 such as for example a database network, and the aforementioned user interface 114 or control panel having a display 118. An input/output device, such as a keyboard, joystick or other user interface tool 116, is provided so that the human operator may input instructions to the controller 112. It is understood that the controller 112 described herein may be a single controller having all of the described functionality, or it may include multiple controllers wherein the described functionality is distributed among the multiple controllers.

Various "computer-implemented" operations, steps or algorithms as described in connection with the controller 112 or alternative but equivalent computing devices or systems can be embodied directly in hardware, in a computer program product such as a software module executed by the processor 150, or in a combination of the two. The computer program product can reside in RAM memory, flash memory, ROM memory, EPROM memory, EEPROM memory, registers, hard disk, a removable disk, or any other form of computer-readable medium 152 known in the art. An exemplary computer-readable medium 152 can be coupled to the processor 150 such that the processor 150 can read information from, and write information to, the memory/storage medium 152. In the alternative, the medium 152 can be integral to the processor 150. The processor 150 and the medium 152 can reside in an application specific integrated circuit (ASIC). The ASIC can reside in a user terminal. In the alternative, the processor 150 and the medium 152 can reside as discrete components in a user terminal.

The term "processor" 150 as used herein may refer to at least general-purpose or specific-purpose processing devices and/or logic as may be understood by one of skill in the art, including but not limited to a microprocessor, a microcontroller, a state machine, and the like. A processor 150 can also be implemented as a combination of computing devices, e.g., a combination of a digital signal processor (DSP) and a microprocessor, a plurality of microprocessors, one or more microprocessors in conjunction with a DSP core, or any other such configuration.

The communication unit 154 may support or provide communications between the controller 112 and external systems or devices, and/or support or provide communication interface with respect to internal components of the self-propelled work machine 20. The communications unit 154 may include wireless communication system components (e.g., via cellular modem, WiFi, Bluetooth, or the like) and/or may include one or more wired communications terminals such as universal serial bus ports.

The data storage 156 as further described below may, unless otherwise stated, generally encompass hardware such as volatile or non-volatile storage devices, drives, memory, or other storage media, as well as one or more databases residing thereon.

Figure 4:
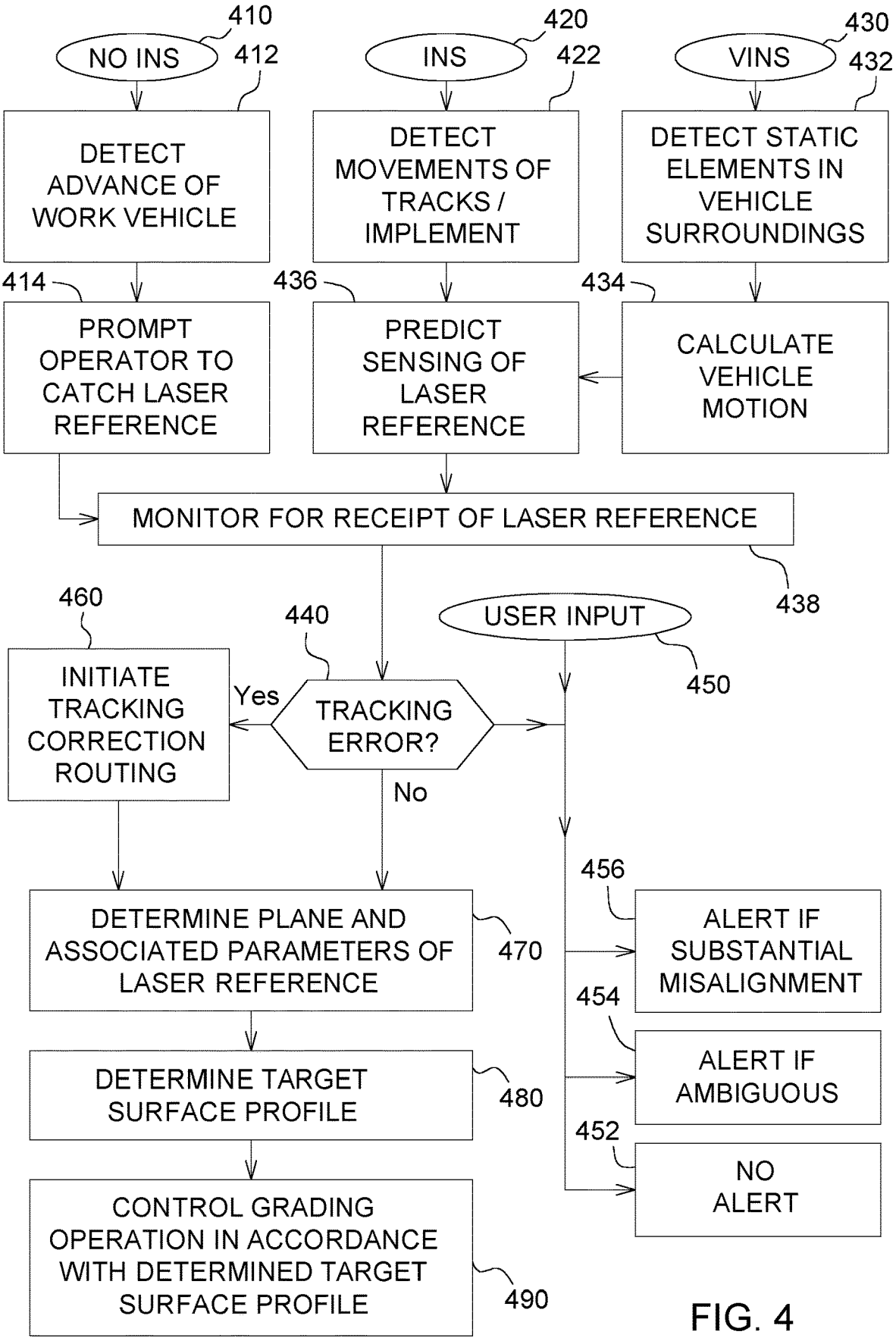
FIG. 4 is a flowchart representing an exemplary embodiment of a method as disclosed herein.

In FIG. 4, the depicted flowchart represents an exemplary embodiment of a method for controlling movements (e.g., associated with grading operations) of one or more work implements 42 for a work machine 20, the work implement 42 of which includes one or more components coupled to a main frame 32 of the work machine 20. In the context of the exemplary work implement 42 of the work machine 20 depicted in FIG. 1, the one or more components may include a boom 44, an arm 46, and a tool 48.

The exemplary method may be described herein with respect to three exemplary embodiments, generally corresponding to a work machine 20 lacking an inertial navigation system (beginning with step 410), a work machine 20 including an inertial navigation system (beginning with step 420), and a work machine 20 further including a visual-inertial navigation system (beginning with step 430). It may be understood that the represented embodiments are non-limiting in nature and that various alternatives may be within the scope of the present disclosure and contemplated by one of skill in the art upon examination of the teachings herein.

Beginning for illustrative purposes with step 420, if a two-dimensional grading system includes a set of sensors 104 including for example a swing angle sensor, it has the ability to calculate an orientation of the ground engaging units 24 of the work machine 20 relative to the plane of the laser reference 72 by capturing the laser transmitted by the laser source 70 at each of a plurality of locations which may correspond to different swing angles. In practice, the system may utilize inertial navigation to calculate how the ground engaging units 24 have moved (step 422) and based thereon to predict when the laser reference 72 plane will be sensed (step 436), based for example on previously stored navigation settings. The system then monitors signals from the laser receiver 102 for receipt of the laser reference 72 (step 438).

If the laser plane is either not sensed when expected, or is sensed when it is not expected to be sensed, the system may be configured to accordingly identify that there has been a tracking error in the INS (i.e., "yes" in response to the query in step 440). It may for example use the actual measurement of the plane of the laser reference 72 to attempt to automatically correct for this tracking error via a tracking correction routine (step 460). As one alternative, the system may prompt the operator via an onboard user interface or the like to capture the laser plane at several other swing angles in order to calculate the slope of the laser plane relative to the machine. If the work machine 20 is moved so that it captures the laser plane in a plurality of positions (e.g., three positions, including at least two substantially different swing angles), it can resolve the orientation of the laser plane with respect to the new track location.

In an embodiment, two or more of the positions in the tracking correction routine may be predetermined, wherein the system automatically directs the implement through a sequence of swing angles, or the operator may be prompted to direct the implement accordingly. For example, a preferred routine may include that at least two of the swing angles are implemented at least a predetermined distance apart from each other. Such positions and/or swing angles may be presented in accordance with a stored and fixed setting, or may be dynamic in nature such that for example the preferred tracking routine may be determined in view of current conditions and/or learned correlations over time.

As the swing angles of the tracking correction routine are implemented, the system can then use the signals from the swing angle sensor in combination with the received laser reference 72 signals to resolve the current slope of the plane in an independent coordinate system of the work machine 20 regardless of how the main frame 32 (or upper) rotates with respect to the tracks. In this way, the work machine may preferably maintain the proper slope regardless of the track orientation relative to the laser plane.

If no tracking error is determined (i.e., "no" in response to the query in step 440), or upon satisfactory completion of the tracking correction routine in step 460, the system determines the orientation and current slope of the laser reference 72 plane in the work machine coordinate system (step 470). For example, as the work machine 20 rotates with the laser receiver 102 in the effective plane of the laser reference 72, a cloud of three-dimensional points may be collected along the corresponding arc. These points may be measured or otherwise converted with respect to the coordinate system of the work machine 20, wherein upon best-fitting (or equivalent) a plane to these three-dimensional points the slope, direction, and height of the laser plane can be found in work machine coordinates. When this information is combined with an offset height value 78 associated with the laser reference 72, the system can determine the target surface profile 76 (step 480).

In an embodiment, the target surface profile is accordingly determined in a work machine coordinate system based on the determined plane of the laser reference and the defined elevation offset, and as further described below movement of one or more components of the work implement 42 is controlled with respect to the determined target surface profile 76. In another embodiment within the scope of the present disclosure, a position of the work machine 20 in a target surface coordinate system may be determined based on the determined plane of the laser reference and the defined elevation offset, wherein movement of one or more components of the work implement 42 is controlled with respect to the determined target surface profile 76.

The grade control system may then (in step 490) direct control of a grading operation in accordance with the determined target surface profile 76, wherein for example movement of the work machine 20 and/or one or more work implement components is controlled or directed based at least in part on the determined target surface profile 76 and further in view of tracked positions of the work implement 42. The tracked positions may include at least one joint characteristic, such as a joint angle, for a respective linkage joint. The controller 112 may be configured to automatically control movement of the one or more work implements of the boom assembly 42 of the work machine 20, via one or more of a steering control unit 126, a swing angle or equivalent implement control unit 128, and an engine speed control unit 130. The human operator may effectuate movement or direction of the ground engaging units 24 and/or one or more work implements by or through the user interface tool 116 of the user interface 114. The controller 112 may, for example, generate control signals for controlling the operation of various actuators, such as hydraulic motors or hydraulic piston-cylinder units 41, 43, and 45, as depicted in FIG. 1.

In some embodiments, a display may be generated including a determined target surface profile 76 or characteristics thereof, as further optionally supplemented by the tracked laser reference 72, the initial or current surface profile 74 as corresponding for example to unworked terrain, and/or joint characteristics, such as joint angles, for respective linkage joints of the boom assembly 42.

In an embodiment wherein the work machine 20 lacks an INS (beginning with step 410), the system may for example detect an advance of the work machine (step 412) but be unable to detect movements of the ground engaging units 24 relative to the machine frame 32 or work implement(s) 42 in the same manner as a work machine equipped with an INS. In this case, the system may prompt the operator to direct movements of the work machine and accordingly the laser receiver 102 so as to catch the laser plane in a plurality of (e.g., three) positions each time the ground engaging units 24 are advanced (step 414). This step enables receipt of the laser reference 72 and determination of tracking errors in similar fashion as with respect to the embodiment beginning with step 420, even though the work machine lacking the INS sensors likewise lacks the ability to predict when the laser receiver 102 will be positioned to catch the laser reference 72.

In another embodiment (beginning with step 430) the work machine 20 may further include a visual-inertial navigation system (VINS) configured to sense, classify, and track stationary features/static elements around the work machine (step 432). The system may then reference these visual markers to the slope of the laser plane. As the ground engaging units 24 are moved, the controller 112 or an equivalent may use the visual markers and/or inertial data to calculate work machine motion and track the orientation and location of the laser plane relative to work machine coordinates (step 434). The system may then predict the location and slope of the laser plane relative to the new location of the tracks after motion (step 436). In an embodiment, when the laser plane is actually detected (step 438), if the error is relatively small (for example by reference to a threshold amount or otherwise outside of a defined range) it may be used for example to correct the VINS system for small tracking errors. If the error was large, the system may be configured to alert the operator to reinitialize the tracking of the laser plane. The operator may for example be prompted by the system to catch the plane in a plurality (e.g., three) different machine poses, wherein tracking and grade control operations may resume as before.

An exemplary VINS may include INS sensors 104 as discussed previously and further in functional association with one or more sensors 108 and communications and/or computing modules effective to process image data or the like there from. VINS sensors 108 may include for example video cameras configured to record an original image stream and transmit corresponding data to the controller 112. In the alternative or in addition, the VINS sensors 108 may include one or more of an infrared camera, a stereoscopic camera, a PMD camera, or the like. One of skill in the art may appreciate that high resolution light detection and ranging (LiDAR) scanners, radar detectors, laser scanners, etc. may likewise be implemented within the scope of the present disclosure. The number and orientation of said sensors 108 may vary in accordance with the type of work machine 20 and relevant applications. For example, the position and size of an image region recorded by a respective camera as a VINS sensor 108 may depend on the arrangement and orientation of the camera and the camera lens system, in particular the focal length of the lens of the camera. One of skill in the art may further appreciate that image data processing functions may be performed discretely at a given image data source if properly configured, but also or otherwise may generally include at least some image data processing by the controller or other downstream data processor. For example, image data from any one or more image data sources may be provided for three-dimensional point cloud generation, image segmentation, object delineation and classification, and the like, using image data processing tools as are known in the art in combination with the objectives disclosed.

Various sensors 108 may collectively define an object detection system, alone or in combination with one or more aforementioned sensors for improved data collection, various examples of which may include ultrasonic sensors, laser scanners, radar wave transmitters and receivers, thermal sensors, imaging devices, structured light sensors, other optical sensors, and the like. The types and combinations of sensors for object detection may vary for a type of work machine 20, work area, and/or application, but generally may be provided and configured to optimize recognition of objects proximate to, or otherwise in association with, a determined working area of the work machine.

In various embodiments as disclosed herein, a plurality of operating modes may be enabled with respect to automated or alert/notification functions. The operating modes may typically be selectable manually according to user input (step 450), but in other embodiments may for example be automatically selected by the system in the absence of a manual selection. In certain exemplary user-selected operating modes, the system may automatically attempt to determine the plane of the laser reference 72 responsive to any movement of the laser receiver 102, and generate output signals to an onboard user interface 114 based on a state of the determined plane of the laser reference 72 and/or the determined target surface profile 76. For example, an alert may be generated if there is ambiguity regarding the orientation of the laser plane with respect to the work machine coordinates (step 454), and/or if a substantial misalignment has been detected (step 456). In another user-selected operating mode (step 452), the laser reference 72 may be automatically monitored for receipt at a plurality of positions for determining a plane of the laser reference 72 without generating an output signal to alert an operator.

As used herein, the phrase "one or more of," when used with a list of items, means that different combinations of one or more of the items may be used and only one of each item in the list may be needed. For example, "one or more of" item A, item B, and item C may include, for example, without limitation, item A or item A and item B. This example also may include item A, item B, and item C, or item Band item C.

Thus, it is seen that the apparatus and methods of the present disclosure readily achieve the ends and advantages mentioned as well as those inherent therein. While certain preferred embodiments of the disclosure have been illustrated and described for present purposes, numerous changes in the arrangement and construction of parts and steps may be made by those skilled in the art, which changes are encompassed within the scope and spirit of the present disclosure as defined by the appended claims. Each disclosed feature or embodiment may be combined with any of the other disclosed features or embodiments.

What is claimed is:

1. A method of operating a work machine comprising a laser receiver and at least one implement for working a terrain, the method comprising:

responsive to movement of the laser receiver, receiving via the laser receiver a laser reference transmitted from a laser source at a plurality of positions relative to the laser source, wherein the laser reference corresponds in slope and direction at a defined elevation offset with respect to a target surface profile of the terrain being worked;

determining a plane of the laser reference from data points corresponding to the plurality of positions at which the laser reference is received by the laser receiver; and controlling movement of at least the at least one implement for working the terrain based at least in part on the determined plane of the laser reference and the defined elevation offset.

2. The method of claim 1, comprising:

determining the target surface profile in a work machine coordinate system based on the determined plane of the laser reference and the defined elevation offset;

wherein movement of at least the at least one implement for working the terrain is controlled with respect to the determined target surface profile.

3. The method of claim 1, comprising:

determining a position of the work machine in a target surface coordinate system based on the determined plane of the laser reference and the defined elevation offset;

wherein movement of at least the at least one implement for working the terrain is controlled with respect to the target surface profile.

4. The method of claim 1, wherein the work machine comprises a frame supported by a plurality of ground engaging units and the at least one implement is configured to selectively rotate about an axis associated with the frame, the method further comprising:

detecting movement of the plurality of ground engaging units;

predicting at least one position at which the laser reference will be received by the laser receiver, based on the detected movement and a calculated orientation of the plurality of ground engaging units relative to the plane of the laser reference; and determining a tracking error based on whether the laser reference is received at the predicted at least one position.

5. The method of claim 4, further comprising generating prompts to an operator via an onboard user interface to initiate a tracking correction routine comprising movements of the laser receiver, responsive to the determining of a tracking error, wherein the laser reference is monitored for receipt at a plurality of positions for determining a corrected plane of the laser reference.

6. The method of claim 5, wherein at least two of the plurality of positions in the tracking correction routine are predetermined.

7. The method of claim 5, wherein at least two of the plurality of positions in the tracking correction routine correspond to swing angles of the implement with respect to the frame of at least a predetermined distance apart.

8. The method of claim 4, further comprising automatically initiating a tracking correction routine, responsive to the determining of a tracking error, wherein the laser reference is monitored for receipt at a plurality of positions for determining a corrected plane of the laser reference.

9. The method of claim 1, wherein the work machine comprises a frame supported by a plurality of ground engaging units and the at least one implement is configured to selectively rotate about an axis associated with the frame, the method further comprising:

detecting movement of the plurality of ground engaging units;

generating prompts to an operator via an onboard user interface to initiate a tracking correction routine, responsive to each time the movement is detected, wherein the laser receiver is moved to receive the laser reference at a plurality of positions for determining a corrected plane of the laser reference.

10. The method of claim 1, further comprising:

automatically attempting to determine the plane of the laser reference responsive to any movement of the laser receiver; and generating output signals to an onboard user interface based on a state of the determined plane of the laser reference and/or the determined target surface profile, further in view of a user-selected operating mode from a plurality of selectable operating modes.

11. The method of claim 10, wherein the laser reference is automatically monitored for receipt at a plurality of positions for determining a plane of the laser reference without generating an output signal to alert an operator in at least one of the plurality of selectable operating modes.

12. The method of claim 10, wherein in at least one of the plurality of selectable operating modes an output signal is generated to alert an operator in accordance with any detected ambiguity regarding an orientation of the plane of the laser reference with respect to a machine coordinate system.

13. The method of claim 10, wherein in at least one of the plurality of selectable operating modes an output signal is generated to alert an operator in accordance with a tracking error greater than a threshold amount from a current plane of the laser reference and an expected plane of the laser reference.

14. The method of claim 1, comprising:

visually sensing and classifying one or more static elements in an area surrounding the work machine, using a visual-inertial navigation system associated with the work machine;

referencing the one or more static elements to the plane of the laser reference; and tracking at least the one or more static elements to determine movements of the work machine and to further track the plane of the laser reference relative to a work machine coordinate system.

15. The method of claim 14, comprising:

upon determining movement of the work machine based on at least the tracked one or more static elements, predicting further based on the tracked one or more static elements at least one position at which the laser reference will be received by the laser receiver; and determining a tracking error based on whether the laser reference is received at the predicted at least one position.

16. The method of claim 15, comprising:

upon detecting the laser reference in a position different from a predicted corresponding position, selectively applying the determined tracking error to correct the navigation system.

17. A work machine comprising:

a laser receiver;

at least one implement for working a terrain; and a controller functionally linked to the laser receiver and the at least one implement, and configured to:

responsive to movement of the laser receiver, receive via the laser receiver a laser reference transmitted from a laser source at a plurality of positions relative to the laser source, wherein the laser reference corresponds in slope and direction at a defined elevation offset with respect to a target surface profile of the terrain being worked;

determine a plane of the laser reference from data points corresponding to the plurality of positions at which the laser reference is received by the laser receiver; and control movement of at least the at least one implement for working the terrain based at least in part on the determined plane of the laser reference and the defined elevation offset.

18. The work machine of claim 17, further comprising a frame supported by a plurality of ground engaging units, wherein the at least one implement is configured to selectively rotate about an axis associated with the frame, and wherein the controller is further configured to:

detect movement of the plurality of ground engaging units;

predict at least one position at which the laser reference will be received by the laser receiver, based on the detected movement and a calculated orientation of the plurality of ground engaging units relative to the plane of the laser reference; and determine a tracking error based on whether the laser reference is received at the predicted at least one position.

19. The work machine of claim 17, wherein the controller is further configured to:

determine the target surface profile in a work machine coordinate system based on the determined plane of the laser reference and the defined elevation offset; and wherein movement of at least the at least one implement for working the terrain is controlled with respect to the determined target surface profile.

20. The work machine of claim 17, wherein the controller is further configured to:

determine a position of the work machine in a target surface coordinate system based on the determined plane of the laser reference and the defined elevation offset; and wherein movement of at least the at least one implement for working the terrain is controlled with respect to the target surface profile.

* * * * *